US007066352B2

(12) United States Patent
Ono et al.

(10) Patent No.: US 7,066,352 B2
(45) **Date of Patent: *Jun. 27, 2006**

(54) MATERIAL SUPPLY SYSTEM

(75) Inventors: Sumino Ono, Kobe (JP); Satoru Kurahashi, Ika-gun (JP); Yoshihiro Sugino, Ika-gun (JP)

(73) Assignee: Heishin Sobi KabushikiKaisha, Hyogo-Pref (JP)

( * ) Notice: Subject to any disclaimer, the term of this patent is extended or adjusted under 35 U.S.C. 154(b) by 370 days.

This patent is subject to a terminal disclaimer.

(21) Appl. No.: 10/801,192

(22) Filed: Mar. 16, 2004

(65) Prior Publication Data

US 2004/0182889 A1 Sep. 23, 2004

(30) Foreign Application Priority Data

Mar. 18, 2003 (JP) ..... 2003-073497
Feb. 6, 2004 (JP) ..... 2004-030229

(51) Int. Cl.
*B67D 5/08* (2006.01)

(52) U.S. Cl. ..... 222/55; 222/386

(58) Field of Classification Search ..... 222/394, 222/55, 52, 386
See application file for complete search history.

(56) References Cited

U.S. PATENT DOCUMENTS 2,710,115 A * 6/1955 Chandler ..... 222/61
4,989,756 A * 2/1991 Kagamihara et al. ..... 222/55
5,199,607 A 4/1993 Shimano
5,277,333 A 1/1994 Shimano
5,487,346 A 1/1996 Taylor
5,992,686 A 11/1999 Cline et al.
6,431,096 B1 8/2002 Engelke et al.
6,799,698 B1 * 10/2004 Ono et al. ..... 222/55

FOREIGN PATENT DOCUMENTS

JP 2002-316081 10/2002

* cited by examiner

*Primary Examiner*—Frederick C. Nicolas
(74) *Attorney, Agent, or Firm*—Marshall, Gerstein & Borun LLP

(57) ABSTRACT

A material supply system includes a plunger pump, a pressure reducing valve, an accumulator and a dispenser. The plunger pump is connected with the pressure reducing valve by a primary supply line. The pressure reducing valve is connected with the dispenser by a secondary supply line. The accumulator is provided in the secondary supply line and has a spring. A pressure sensor senses the pressure nearly at the inlet port of the dispenser. The sensed pressure is the basis for controlling the pressure reduction ratio of the pressure reducing valve. The second chamber of the accumulator stores a sealing compound or other material. The second chamber varies in volume with the balance between the pressure in the secondary supply line and the force of the accumulator spring so as to relax the pressure fluctuation in this line.

2 Claims, 4 Drawing Sheets

MATERIAL SUPPLY SYSTEM

BACKGROUND OF THE INVENTION

1. Field of the Invention

The present invention relates to a material supply system, which may be used in a car assembly plant to coat automotive components or works with constant amounts of liquid material such as a sealing compound, or to fill them with constant amounts of liquid material such as an adhesive or grease.

2. Description of the Related Art

Generally, in a car assembly plant, a plunger pump, which is a high pressure pump, sucks liquid material such as a sealing compound or an adhesive from a storage tank and supplies it through supply lines to dispensers, each of which is connected to one of the lines. The dispensers coat or fill works with the liquid material. In such a system, a plunger pump or another high pressure pump is used to supply liquid material to one or more distant places.

FIG. 4 of the accompanying drawings shows a conventional system for supplying a sealing compound or other liquid material from a storage tank 108 to two or more distant dispensers 103, one of which is shown, for coating works with the material. With reference to FIG. 4, a plunger pump 101 is connected with supply lines 102, one of which is shown. Each supply line 102 is connected with one of the dispensers 103.

The supply line 102 consists of a primary supply line 102' and a secondary supply line 102", and is fitted with a pressure reducing valve 104. The primary supply line 102' is upstream of the pressure reducing valve 104 and high in pressure. The secondary supply line 102" is downstream of the pressure reducing valve 104 and low in pressure. The pressure in the primary supply line 102' is kept at a high value of about 15 MPa (150 kg/cm2). The secondary supply line 102" is fitted with an air-operated valve 105 as an on-off valve.

The plunger pump 101 sucks the liquid material from the storage tank 108 and supplies it under high pressure to the supply lines 102, from which it is supplied to the respective dispensers 103. The dispensers 103 discharge the liquid material directly onto the works so as to coat or fill them with constant amounts of liquid material.

The pressure in the secondary supply lines 102" of the supply lines 102 (the proper supply pressure for the dispensers 103) is low for the following reason. Because the dispensers 103 are mounted on a robot (not shown) or the like, it is preferable that they be small in size, light in weight and able to discharge constant amounts of liquid material. The dispensers 103 may be small-capacity single-shaft eccentric screw pumps. It is necessary that the discharge pressure of the dispensers 103 be very low in comparison with that of the high pressure pump on the supply side. In other words, there is an upper limit to the supply pressure for the dispensers 103.

Each dispenser 103 is fitted with a pressure sensor 106 near its inlet port 103*a*. This sensor 106 senses the pressure nearly at the inlet port 103*a* and outputs a pressure signal to an electromagnetic valve 107, which controls the switching operation of the associated air-operated valve 105 according to the sensed pressure. The air-operated valve 105 is closed if the sensed pressure is higher than a set upper limit value, which may be 0.7 MPa. This valve 105 is opened if the sensed pressure is lower than a set lower limit value, which may be 0.3 MPa.

The dispenser 103 intermittently discharges the liquid material. In order to supply the dispenser 103 with a sufficient amount of liquid material every time the dispenser starts discharging the material after it stops discharging the material, it is necessary to keep the pressure in the associated secondary supply line 102" high to some extent.

Therefore, as soon as the dispenser 103 stops discharging the liquid material, the pressure in the secondary supply line 102" rises. When this pressure exceeds the upper limit value, the air-operated valve 105 is closed. Thereafter, as soon as the dispenser 103 starts discharging the liquid material, the pressure in the secondary supply line 102" falls. When this pressure falls below the lower limit value, the air-operated valve 105 is opened. Thus, every time the dispenser 103 starts and stops discharging the liquid material, the pressure in the secondary supply line 102" falls below the lower limit value and rises above the upper limit value. As a result, the air-operated valve 105 frequently closes and opens. This may wear away the air-operated valve 105 and shorten its life.

The applicant's Japanese Unexamined Patent Publication No. 2002-316081 (para. 0017–0020) discloses a material supply system including a supply device and a dispenser, which is connected to the supply device by a supply line. The supply line is fitted with a pressure reducing valve, an on-off valve and a buffer pump, which is a single-shaft eccentric screw pump. The pressure reducing valve is interposed between the supply device and the on-off valve. The screw pump is interposed between the on-off valve and the dispenser. The operation of the buffer pump and on-off valve is controlled on the basis of the pressure in the supply line between this pump and the dispenser. The use of the buffer pump enables the pressure reducing valve to achieve a larger pressure reduction than in the system shown in FIG. 4. This reduces the pressure acting on the dispenser, and prevents liquid from dripping when the dispenser stops and reverses.

As is the case with the system shown in FIG. 4, however, the on-off valve of the system disclosed in the Japanese publication frequently closes and opens. This may shorten the life of the on-off valve, which is expensive.

SUMMARY OF THE INVENTION

The object of the present invention is to provide a simple and low-cost material supply system without an on-off valve, which is expensive and the life of which might be shortened.

A material supply system according to one aspect of the present invention includes a supply device, a pressure reducing valve, an accumulator, a pressure sensor, and a discharger for quantitative supply of material to a work. The supply device sucks material from a storage tank or another reservoir. The supply device has an outlet port, through which the sucked material is supplied under high pressure. The outlet port is connected with the inlet of a primary supply line, through which the sucked material is supplied under a first pressure. The pressure reducing valve is connected between the outlet of the primary supply line and the inlet of a secondary supply line, through which the sucked material is supplied under a second pressure. The pressure reducing valve makes the second pressure lower than the first pressure. The discharger has an inlet port, which is connected with the outlet of the secondary supply line. The pressure sensor senses the port pressure nearly at the inlet port of the discharger and outputs a pressure signal as the basis for controlling the second pressure. On the basis of the pressure signal, the pressure reduction ratio of the pressure reducing valve is so controlled that, if the sensed pressure is higher than a set upper limit value, the valve is fully closed, and that, if the sensed pressure is lower than a set lower limit value, the opening of the valve is adjusted to a value at which a slightly larger amount of material can flow through the valve than the total amount of material flowing therethrough while the discharger is operating. The accumulator is provided on the secondary supply line. When the accumulator is filled with material, its internal pressure rises. The accumulator restrains the port pressure from exceeding the upper limit value and from falling below the lower limit value.

By combining the pressure reducing valve, the pressure reduction ratio of which can be controlled, and the accumulator, it is possible to obviate the need for an on-off valve, which is expensive and the life of which might be shortened.

The combination of the pressure reducing valve and the accumulator prevents the supply pressure in the secondary supply line from exceeding the upper limit value and falling below the lower limit value. This obviates the need for an on-off valve as conventionally needed, which is expensive and the life of which might be shortened.

More specifically, it is possible to suitably control the pressure reduction ratio of the pressure reducing valve so as to adjust the average flow within a certain fixed time, according to the discharging cycle of the discharger. This obviates the need for an on-off valve, which is expensive and the life of which might be shortened. While the discharger is discharging material, the opening of the pressure reducing valve may be adjusted to a value at which the flow through the secondary supply line is slightly more than the average flow for safety. This avoids the shortage of material supply.

The accumulator varies the supply pressure for the discharger, but this does not affect the discharge operation of the discharger because the discharger can quantitatively supply a work with material.

A material supply system according to another aspect of the present invention includes a supply device, an automatic pressure regulating valve, an accumulator, a pressure sensor, and a discharger for quantitative supply of material to a work. The supply device sucks material from a storage tank or another reservoir. The supply device has an outlet port, through which the sucked material is supplied under high pressure. The outlet port is connected with the inlet of a primary supply line. The pressure regulating valve is connected between the outlet of the primary supply line and the inlet of a secondary supply line, through which the sucked material is supplied under a supply pressure. The pressure regulating valve adjusts the supply pressure to a set value. The discharger has an inlet port, which is connected with the outlet of the secondary supply line. The pressure sensor senses the port pressure nearly at the inlet port of the discharger and outputs a pressure signal as the basis for controlling the supply pressure. On the basis of the pressure signal, the opening of the pressure regulating valve is so controlled as to reduce the supply pressure if the sensed pressure is higher than a set value, and as to increase the supply pressure if the sensed pressure is lower than the set value. The accumulator is provided on the secondary supply line. When the accumulator is filled with material, its internal pressure rises. The accumulator makes the port pressure roughly equal to the set value.

Thus, the accumulator makes the supply pressure in the secondary supply line roughly equal to the set value. Accordingly, deviations are liable to appear in the pressure signals, with which the port pressure can be adjusted nearly to the set value by the pressure regulating valve. This makes the port pressure easy to adjust.

There is a pressure difference in the secondary supply line between when the quantitative discharger discharges the liquid material and when it stops discharging the material. With the pressure reduction ratio of the pressure reducing valve or the opening of the pressure regulating valve suitably controlled, the pressure difference is adjusted by the internal volume change of the second chamber of the accumulator. This prevents the material supply pressure for the discharger from exceeding the upper limit value and falling below the lower limit value. Accordingly, the pressure in the secondary supply line is maintained between the two limit values, so that there is no need for an on-off valve as conventionally needed, which is expensive and the life of which might be shortened.

As stated above, the accumulator makes the supply pressure in the secondary supply line roughly equal to the set value. Accordingly, deviations are liable to appear in the pressure signals, with which the port pressure can be adjusted nearly to the set value by the pressure regulating valve. This makes the port pressure easy to adjust.

BRIEF DESCRIPTION OF THE DRAWINGS

Preferred embodiments of the present invention are described below in detail with reference to the accompanying drawings, in which.

DETAILED DESCRIPTION OF THE PREFERRED EMBODIMENTS

Figure 1:
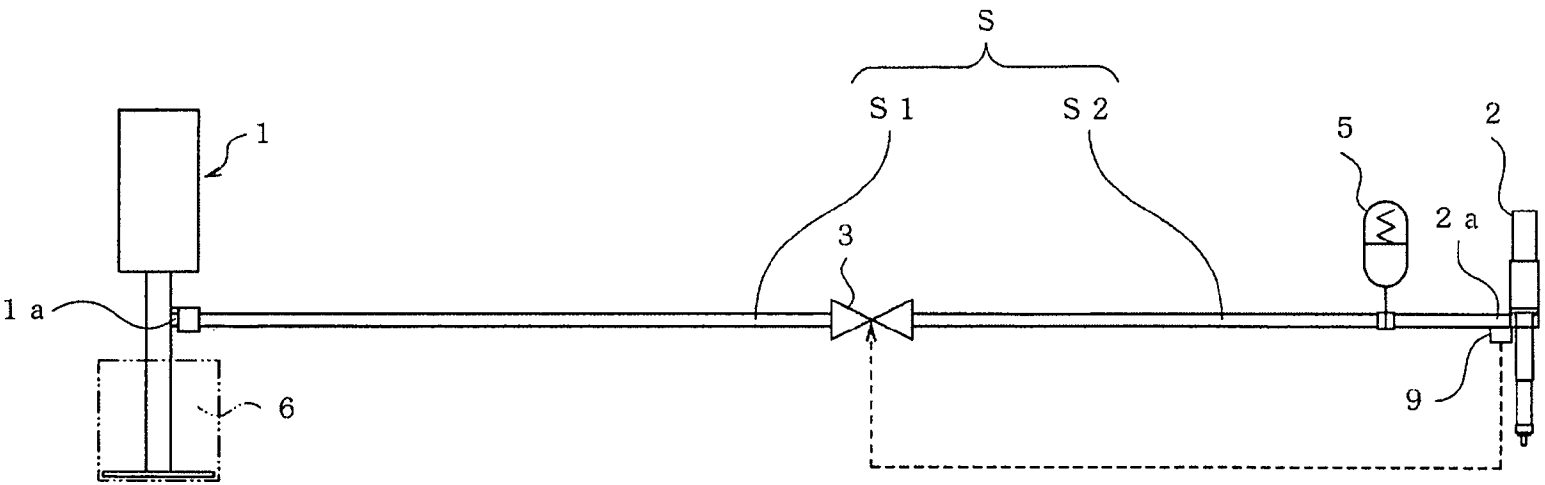
FIG. 1 is a schematic diagram of a material supply system embodying the invention.

FIG. 1 shows a material supply system according to a preferred embodiment of the present invention. This system can be used to coat automotive components or other works with a sealing compound (a coating liquid) in a car production plant or the like.

With reference to FIG. 1, a plunger pump 1 as a supply device, which is a high pressure pump, sucks liquid material from a storage tank 6. The outlet port 1*a* of the plunger pump 1 is connected to two or more supply lines S, one of which is shown, each connected to the inlet port 2*a* of a distant dispenser 2. The plunger pump 1 supplies the sucked material under high pressure (about 15 MPa) to the supply lines S, from which the material is supplied to the respective dispensers 2. The dispensers 2 coat works with constant amounts of liquid material.

Each supply line S is fitted with a pressure reducing valve 3, the pressure reduction ratio of which can be controlled either pneumatically or electrically. The supply line S consists of a primary supply line S1 and a secondary supply line S2. The primary supply line S1 is upstream of the pressure reducing valve 3 and high in pressure. The secondary supply line S2 is downstream of the pressure reducing valve 3 and low in pressure. The secondary supply line S2 is fitted with a small accumulator 5 of the spring type.

The dispenser 2 is fitted with a pressure sensor 9 near its inlet port 2*a*. The pressure sensor 9 senses the pressure nearly at the inlet port 2*a* and outputs a pressure signal. The pressure reduction ratio of the pressure reducing valve 3 is controlled according to the pressure signal, which represents the pressure nearly at the dispenser port 2*a*. In other words, the pressure reducing valve 3 keeps the pressure within a preset range.

More specifically, the pressure nearly at the dispenser port 2*a* can be kept between a preset upper limit value and a preset lower limit value, which may be 0.7 and 0.3 MPa, respectively. If the pressure sensed by the pressure sensor 9 is higher than the upper limit value, the pressure reducing valve 3 is fully closed. If the sensed pressure is lower than the lower limit value, the opening of the pressure reducing valve 3 is adjusted to a value at which a slightly larger amount of liquid material can flow through this valve than the total amount of liquid material flowing through it while the dispenser 2 is operating.

Figure 2:
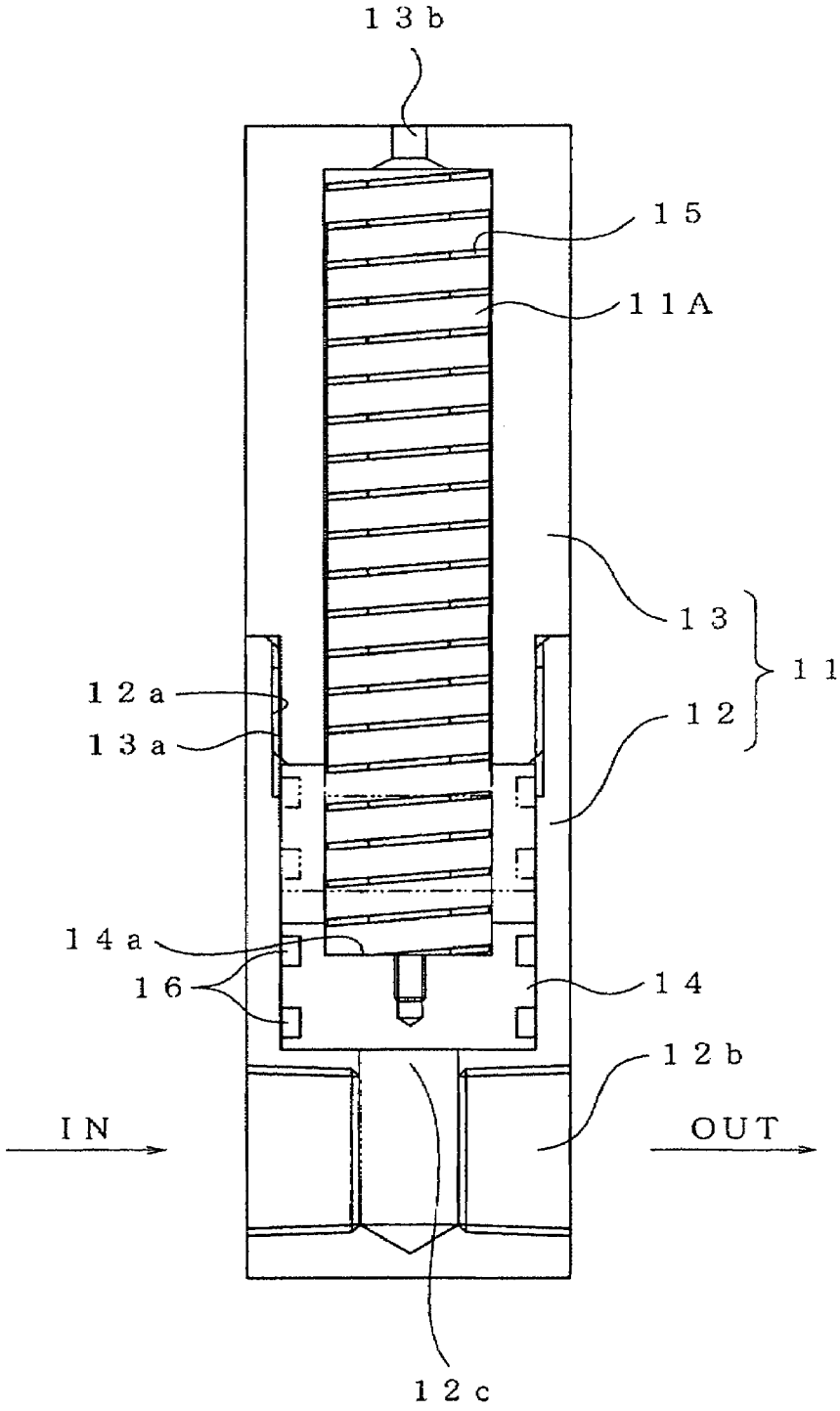
FIG. 2 is a cross section of the accumulator of the system shown in FIG. 1.

The accumulator 5 is a spring type accumulator, which does not need air piping or other control piping. As shown in FIG. 2, the accumulator 5 includes a generally cylindrical casing 11, which consists of a lower casing 12 and an upper casing 13. A lower portion of the upper casing 13 has a male thread 13*a*. An upper portion of the lower casing 12 has a female thread 12*a*, which engages with the male thread 13*a*.

A piston 14 can slide in the casing 11, and defines a first chamber 11A and a second chamber on its upper and lower sides, respectively, in the casing 11. In FIG. 2, the volume of the second chamber is zero. The first chamber 11A functions as a spring chamber, which is fitted with a compression spring 15. The compression spring 15 biases the piston 14 downward. The compression spring 15 is substantially equal in diameter to the first chamber 11A. The top of the first chamber 11A has a hole 13*b* formed through it so that the pressure in this chamber is equal to the atmospheric pressure. The pressure in the accumulator 5 rises as the second chamber is filled.

The lower casing 12 has a passage 12*b*, which is part of the secondary supply line S2, and another passage 12*c*, through which the passage 12*b* communicates with the second chamber of the accumulator 5. The peripheral surface of the piston 14 is fitted with sealing media 16 in contact with the casing 11. The top of the piston 14 has a spring seat 14*a* formed in it, in which the bottom of the spring 15 is seated.

The dispenser 2 is a small vertical single-shaft eccentric screw pump. As well known, a single-shaft eccentric screw pump includes an elastic stator, a metallic spiral rotor, a flexible connecting rod and a reversible servomotor, which is connected to an encoder. The stator has a spiral space that is elliptic in cross section. The spiral rotor is circular in cross section, and its pitch is half the pitch of the spiral space. The spiral rotor can rotate slidably in the spiral space. One end of the connecting rod is connected to one end of the spiral rotor eccentrically from the rotor. The other end of the connecting rod is connected to the driving shaft of the servomotor.

The material supply system according to this embodiment can be used as follows.

(1) The plunger pump 1 sucks the liquid material from the storage tank 6 and supplies it under high pressure (15 MPa) to the primary supply lines S1, so that the pressure in them is kept high (15 MPa). Each pressure reducing valve 3 restricts the flow of the liquid material in the associated secondary supply line S2 so that the pressure in this line can be greatly reduced (4 MPa).

(2) The dispensers 2 discharge constant amounts of liquid material onto works, coating the works at a constant width along predetermined coating lines on the works. When the dispensers 2 finish coating the works, the dispensers stop operating (discharging the material).

(3) In the conventional system (FIG. 4), when each dispenser 103 is not operating, the pressure sensed by the associated pressure sensor 106 exceeds the upper limit value, which may be 0.7 MPa, so that the associated air-operated valve 105 is fully closed. In this embodiment, when the pressure in each secondary supply line S2 rises, and the associated pressure reducing valve 3 becomes fully closed, the surplus of the liquid material in this line S2 is accumulated in the second chamber of the associated accumulator 5. This prevents the pressure in the secondary supply line S2 from rising.

(4) In the conventional system (FIG. 4), when the dispenser 103 starts to operate, the pressure sensed by the pressure sensor 106 falls below the lower limit value, which may be 0.3 MPa, so that the air-operated valve 105 is fully open. In this embodiment, when the pressure in the secondary supply line S2 lowers, and the pressure reducing valve 3 becomes fully open, the liquid material in the second chamber of the accumulator 5 is supplied to this line S2 so that the material accumulated in the accumulator can compensate for the material shortage in the line S2. This prevents the pressure in the secondary supply line S2 from falling below the lower limit value.

(5) In other words, by suitably controlling the opening of the pressure reducing valve 3 and providing the accumulator 5, it is possible to restrain the pressure in the secondary supply line S2 from exceeding the upper limit value and falling below the lower limit value.

Although the provision of the accumulator 5 changes the supply pressure of the liquid material, the dispenser 2 can still discharge a constant amount of liquid material.

Figure 4:
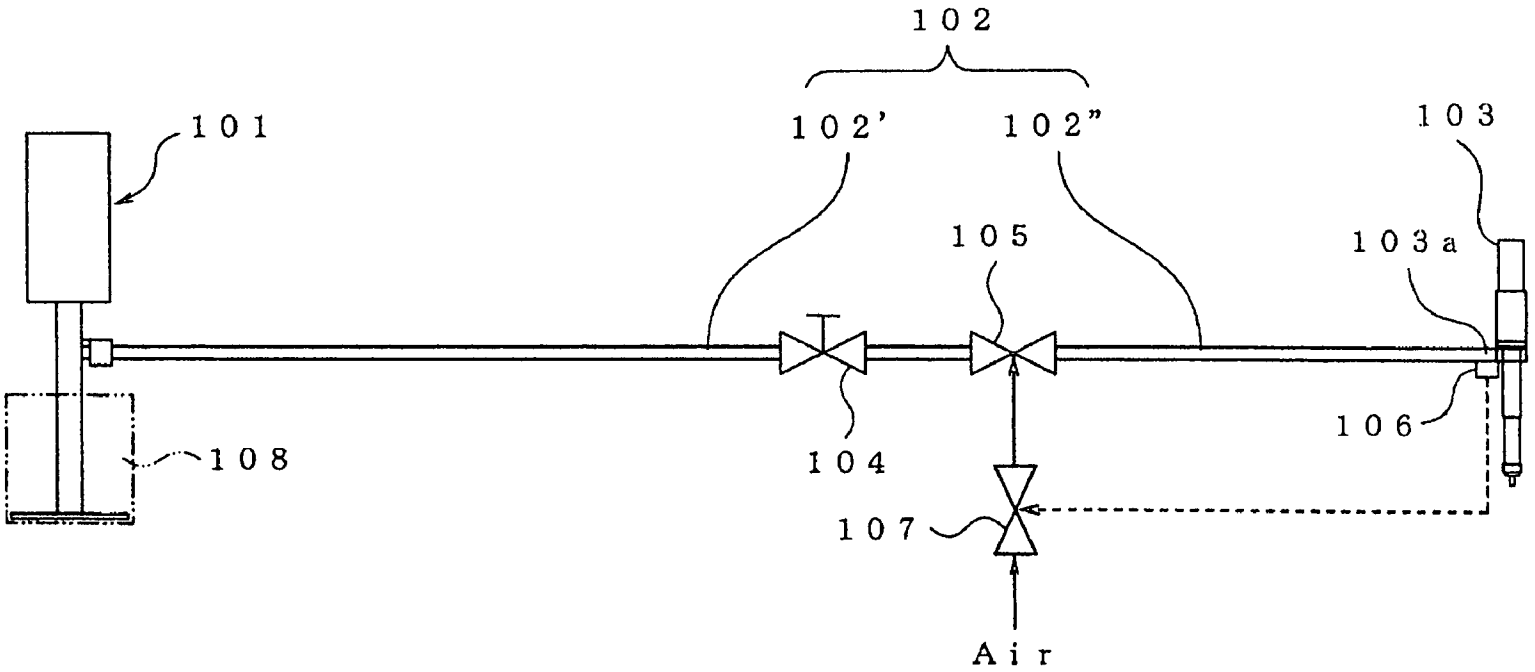
Fig. 4 Prior Art
FIG. 4 is a schematic diagram of a conventional material supply system.

(6) The dispenser 2 repeats discharge in a constant cycle when the dispenser 2 discharges the liquid material after it stops discharging the material, it needs to be supplied with a sufficient amount of liquid material. If the necessary amount of liquid material becomes short, the shortage is compensated for by the material accumulated in the second chamber of the accumulator 5. Accordingly, the pressure in the secondary supply line S2 does not need to be kept as high as that for the conventional system (FIG. 4).

Consequently, a greater pressure reduction can be made by the pressure reducing valve 3 than for the conventional system so that the pressure in the secondary supply line S2 can be lower than that for the conventional system. Accordingly, the pressure resistance of parts on and for the secondary supply line S2 does not need to be as high as that for the conventional system.

The material supply system according to this embodiment may be modified as follows.

(i) The pressure reducing valves 3 may be available on the market or special. In this case, in general, even if each pressure reducing valve 3 is fully closed while the associated dispenser 2 is not operating, this valve does not completely shut off the liquid material flowing through it. Even if the pressure reducing valve 3 is thus fully closed, liquid material may leak through it into the associated secondary supply line S2. In this case, in general, if the pressure in the secondary supply line S2 becomes high, the surplus of the liquid material in this line is accumulated in the second chamber of the accumulator 5 so that the pressure can avoid rising.

If more liquid material leaks, however, an orifice or another choke might be provided downstream of the pressure reducing valve 3 to limit the flow through the secondary supply line S2.

(ii) Each pressure reducing valve 3 could be not only adjusted on the basis of the pressure signal from the associated pressure sensor 9 but also manually adjusted. This would make it possible to close the pressure reducing valve 3 fully by hand, whether the choke is provided or not, in a case where liquid material leaks through this valve even while the valve is closed.

(iii) As stated earlier on, each accumulator 5 is a spring type accumulator. Alternatively, the accumulator 5 might be a pneumatic control accumulator or another accumulator in which the pressure is raised by the liquid filled into its second chamber.

(iv) The material supply system is a quantitative coating system, and its dispensers 2 coat works with constant amounts of liquid material at a time. Alternatively, this system might be a quantitative filling system, which includes dispensers for filling works with constant amounts of liquid material at a time.

Figure 3:
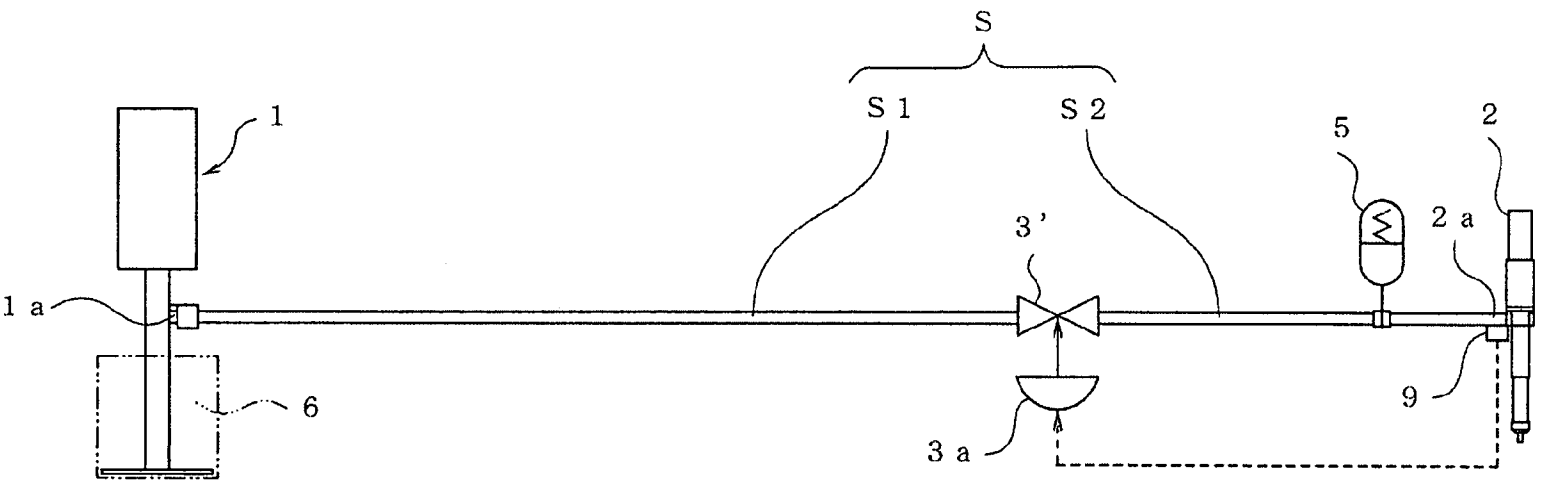
FIG. 3 is a schematic diagram of another material supply system embodying the invention.

(v) Each pressure reducing valve 3 might, as shown in FIG. 3, be replaced by an automatic pressure regulating valve 3', which cooperates with a diaphragm device 3*a* having a diaphragm. On the basis of the pressure signal from the associated pressure sensor 9, the diaphragm could be displaced so as to control the opening of the pressure regulating valve 3'. There is a pressure difference in the associated secondary supply line S2 between when the associated quantitative dispenser 2 discharges the liquid material and when it stops discharging the material. The pressure difference is adjusted by the internal volume change of the second chamber of the associated accumulator 5. Accordingly, deviations would be liable to appear in the pressure signals, with which the pressure nearly at the inlet port 2*a* of the dispenser 2 would be adjusted nearly to a set value by the pressure regulating valve 3'. This would make the pressure easy to adjust. The pressure in the secondary supply line S2 would be maintained at the set value, so that there would be no need for an on-off valve as conventionally needed, which is expensive and the life of which might be shortened.

What is claimed is:

1. A material supply system comprising:

a supply device for sucking material from a storage tank or another reservoir, the supply device having an outlet port through which the sucked material is supplied under high pressure;

a primary supply line connected at an inlet thereof with the outlet port of the supply device for supplying the sucked material under a first pressure through the primary supply line;

a secondary supply line for supplying the sucked material under a second pressure;

a pressure reducing valve connected between an outlet of the primary supply and an inlet of the secondary supply line for making the second pressure lower than the first pressure;

a discharger for quantitative supply of material to a work, the discharger having an inlet port connected with the outlet of the secondary supply line;

a pressure sensor for sensing an port pressure nearly at the inlet port of the discharger and outputting a pressure signal as the basis for controlling the second pressure;

wherein, on the basis of the pressure signal, the pressure reduction ratio of a pressure reducing valve is so controlled that, if the sensed pressure is higher than a set upper limit value, the valve is fully closed, and that, if the sensed pressure is lower than a set lower limit value, the opening of the valve is adjusted to a value at which a slightly larger amount of material can flow through the valve than the total amount of material flowing therethrough while the discharger is operating; and an accumulator provided on the secondary supply line;

wherein an internal pressure of the accumulator rises when the accumulator is filled with the material, and wherein the accumulator restrains the port pressure from exceeding the upper limit value and from falling below the lower limit value.

2. A material supply system comprising:

a supply device for sucking material from a storage tank or another reservoir, the supply device having an outlet port through which the sucked material is supplied under high pressure;

a primary supply line connected at an inlet thereof with the outlet port of the supply device;

a secondary supply line for supplying the sucked material under a supply pressure;

an automatic pressure regulating valve connected between an outlet of the primary supply line and an inlet of the secondary supply line for adjusting the supply pressure to a set value;

a discharger for quantitative supply of material to a work, the discharger having an inlet port connected with an outlet of the secondary supply line;

a pressure sensor for sensing a port pressure nearly at the inlet port of the discharger and outputting a pressure signal as the basis for controlling the supply pressure;

wherein, on the basis of the pressure signal, the opening of the pressure regulating valve is so controlled as to reduce the supply pressure if the sensed pressure is higher than a set value, and as to increase the supply pressure if the sensed pressure is lower than the set value; and an accumulator provided on the secondary supply line;

wherein an internal pressure of the accumulator rises when the accumulator is filled with the material, and wherein the accumulator makes the port pressure roughly equal to the set value.

* * * * *

UNITED STATES PATENT AND TRADEMARK OFFICE

CERTIFICATE OF CORRECTION

PATENT NO. : 7,066,352 B2
APPLICATION NO. : 10/801192
DATED : June 27, 2006
INVENTOR(S) : Sumio Ono et al.

It is certified that error appears in the above-identified patent and that said Letters Patent is hereby corrected as shown below:

Title Page, Item 73, "KabushikiKaisha" should be --Kabushiki Kaisha--.

Signed and Sealed this

Twentieth Day of March, 2007

JON W. DUDAS
*Director of the United States Patent and Trademark Office*